US011088466B2

(12) United States Patent
Gorcea

(10) Patent No.: US 11,088,466 B2
(45) Date of Patent: Aug. 10, 2021

(54) ANTENNAS AND DEVICES, SYSTEMS, AND METHODS INCLUDING THE SAME

(71) Applicant: Flex Ltd., Singapore (SG)

(72) Inventor: Dan Gorcea, Kanata (CA)

(73) Assignee: Flex Ltd., Singapore (SG)

( * ) Notice: Subject to any disclaimer, the term of this patent is extended or adjusted under 35 U.S.C. 154(b) by 0 days.

(21) Appl. No.: 16/413,122

(22) Filed: May 15, 2019

(65) Prior Publication Data

US 2020/0044359 A1 Feb. 6, 2020

Related U.S. Application Data

(60) Provisional application No. 62/712,778, filed on Jul. 31, 2018.

(51) Int. Cl.

| | |
|---|---|
| ***H01Q 1/24*** | (2006.01) |
| ***H01Q 21/06*** | (2006.01) |
| ***H01Q 1/36*** | (2006.01) |
| ***H01Q 1/38*** | (2006.01) |

(52) U.S. Cl.

CPC ..... *H01Q 21/061* (2013.01); *H01Q 1/245* (2013.01); *H01Q 1/364* (2013.01); *H01Q 1/38* (2013.01)

(58) Field of Classification Search

CPC ..... H01Q 1/36; H01Q 1/38; H01Q 1/243; H01Q 1/245; H01Q 1/364; H01Q 9/42; H01Q 21/061

USPC ..... 343/700 MS, 702, 846

See application file for complete search history.

(56) References Cited

U.S. PATENT DOCUMENTS

| | | | | |
|---|---|---|---|---|
| 4,386,357 | A | 5/1983 | Patton | |
| 8,599,074 | B2 * | 12/2013 | Wong | H01Q 9/0471 343/702 |
| 9,178,274 | B2 * | 11/2015 | Wong | H01Q 1/36 |
| 2005/0057416 | A1 | 3/2005 | Yuanzhu | |
| 2008/0024366 | A1 * | 1/2008 | Cheng | H01Q 9/42 343/700 MS |
| 2013/0099982 | A1 * | 4/2013 | Andrenko | H01Q 5/40 343/700 MS |
| 2015/0048990 | A1 * | 2/2015 | Feller | H01Q 1/36 343/848 |
| 2017/0062953 | A1 * | 3/2017 | Teshima | H01Q 3/24 |
| 2019/0089053 | A1 * | 3/2019 | Yong | H01Q 3/26 |

FOREIGN PATENT DOCUMENTS

| | | |
|---|---|---|
| CN | 101114733 | 4/2011 |
| EP | 1933417 | 6/2008 |

OTHER PUBLICATIONS

"2.4-GHz Inverted F Antenna," Application Report; Texas Instruments, SWRU120C—Apr. 2007, 13 pages.

"GPS/GLONASS Dual-Band Ceramic Patch Embedded Antenna 18×18×2mm," Taoglas Antenna Solutions, Apr. 2015, 16 pages.

(Continued)

*Primary Examiner* — Tung X Le

(74) *Attorney, Agent, or Firm* — Sheridan Ross P.C.

(57) ABSTRACT

An antenna structure includes a first conductive element including a first planar portion, and an extension portion that extends away from the first planar portion at a center of the first planar portion. The antenna structure may include a second conductive element spaced apart from the first planar portion and electrically connected to the extension portion.

19 Claims, 11 Drawing Sheets

(56) References Cited

OTHER PUBLICATIONS

Nguyen-Trong et al., "A Frequency- and Pattern-Reconfigurable Center-Shorted Microstrip Antenna," IEEE Antennas and Wireless Propagation Letters, Mar. 2016, vol. 15, pp. 1955-1958.
Chan et al., "Wideband planar inverted-F antenna with meandering shorting strip," Electronics Letters, IEEE Mar. 2008, vol. 44(6), pp. 395-396, 2 pages.
Extended European Search Report for European Patent Application No. 19174544.7, dated Sep. 16, 2019, 13 pages.
Official Action for European Patent Application No. 19174544.7, dated May 14, 2021 13 pages.

* cited by examiner

ANTENNAS AND DEVICES, SYSTEMS, AND METHODS INCLUDING THE SAME

CROSS REFERENCE TO RELATED APPLICATIONS

The present application claims the benefits of and priority, under 35 U.S.C. § 119(e), to U.S. Provisional Application Ser. No. 62/712,778, filed on Jul. 31, 2018, the entire disclosure of which is hereby incorporated by reference, in its entirety, for all that it teaches and for all purposes.

FIELD

Example embodiments relate generally to antennas and devices, systems, and methods including the same.

BACKGROUND

Related art antennas (e.g., F-type antennas, patch antennas, etc.) have limited frequency bands and/or operating modes. Current solutions to these issues come at the cost of performance of the antenna (radiation efficiency, gain, etc.). Related art antennas may also require tuning and carefully controlled manufacturing processes in order to achieve a desired frequency band.

DETAILED DESCRIPTION

An antenna according to example embodiments allows for dual frequency band operation and a single wide band. This is achieved with a design that has little or no effect on antenna performance (gain, efficiency, etc.). For example, a T-antenna according to example embodiments has the ability to function in two distinct modes (e.g., even and odd modes) of resonant frequencies without modifying the structure of the antenna. The frequencies of those two modes can be controlled depending on design preferences. Depending on the frequency value of those modes, the T-antenna can either: resonate and function in two different frequency bands or combine those two modes in a single larger frequency band not possible with related art antenna designs.

The T-shaped concept can also be applied to patch antennas in order to increase the frequency bandwidth to a desired value. Benefits of the T-antenna dual frequency bands include improved radiation efficiency and improved return loss for the two distinct band. Additional benefits include that the T-antenna reduces process variation problems ensures that the desired frequency band is thoroughly covered, with margin to spare.

In view of the above and the following, it should be appreciated that an antenna according to example embodiments allows for the dual mode operation, each mode with its own distinctive frequency. By moving the frequencies of those modes (e.g., by varying the length of the short to ground), the antenna can be either: 1) dual band when the frequencies of the modes are quite far apart; or 2) single wide band when the frequencies of those modes are so close one to each other that they create a single wide band.

These and other needs are addressed by the various aspects, embodiments, and/or configurations of the present disclosure.

Figure 1:
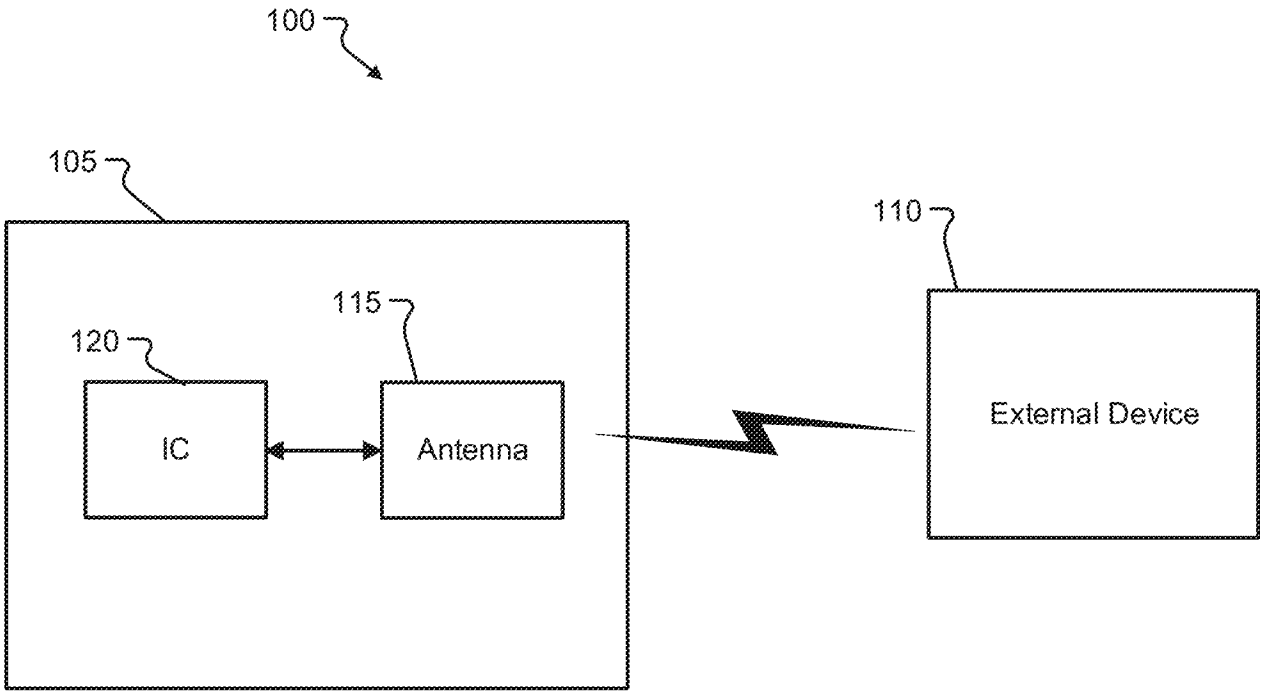
FIG. 1 is a block diagram of a system according to at least one example embodiment.

FIG. 1 is a block diagram of a system 100 according to at least one example embodiment. The system 100 includes a communication device 105 and an external device 110 capable of communicating with one another over a wireless connection at one or more desired frequencies using one or more desired protocols (e.g., for near-field communication (NFC), Wi-Fi, BLUETOOTH, global position system (GPS), etc.). The communication device 105 and/or the external device 110 may be a mobile device such as a smart phone, a piece of wearable technology (e.g., a smart watch, a fitness band, etc.). Additionally or alternatively, the communication device 105 and/or the external device 110 may be a stationary device mounted to or placed on a surface, such as a smart thermostat, or other piece of smart home technology. In other words, the communication device 105 and the external device 110 may be any two devices where wireless communication between the devices is desired.

The communication device 105 may include an antenna 115 and an integrated circuit (IC) 120 that processes signals received and/or sent by the antenna 115. For example, when the antenna 115 is in the presence of the external device 110, the IC 120 may facilitate two-way communication between the communication device 105 and the external device 110 through the antenna 115. Although not explicitly shown, it should be understood that the external device 110 may include its own corresponding IC and antenna to communicate with the communication device 105. In this case, the external device 110 may have the same IC and the same antenna as the communication device 105. Details of the antenna 115 are discussed below with reference to FIGS. 2-8.

The communication device 105 and/or the external device 110 may be an active device or a passive device. If the communication device 105 and/or the external device 110 is an active device, then a power source (e.g., a battery) may be included in the respective device for providing power to a respective IC. If the communication device 105 and/or the external device 110 is a passive device, then the respective device does not include a power source and may rely on signals received at a respective antenna to power the respective IC. In at least one example embodiment, one of the communication device 105 or the external device 110 is an active device while the other of the communication device 105 or the external device 110 is a passive device. However, example embodiments are not limited thereto, and both devices 105/110 may be active devices if desired.

The IC 120 may comprise one or more processing circuits capable of controlling communication between the communication device 105 and the external device 110. For example, the IC 120 includes one or more of an application specific integrated circuit (ASIC), a processor and a memory (e.g., nonvolatile memory) including instructions that are executable by the processor, programmable logic gates, etc.

Figure 2:
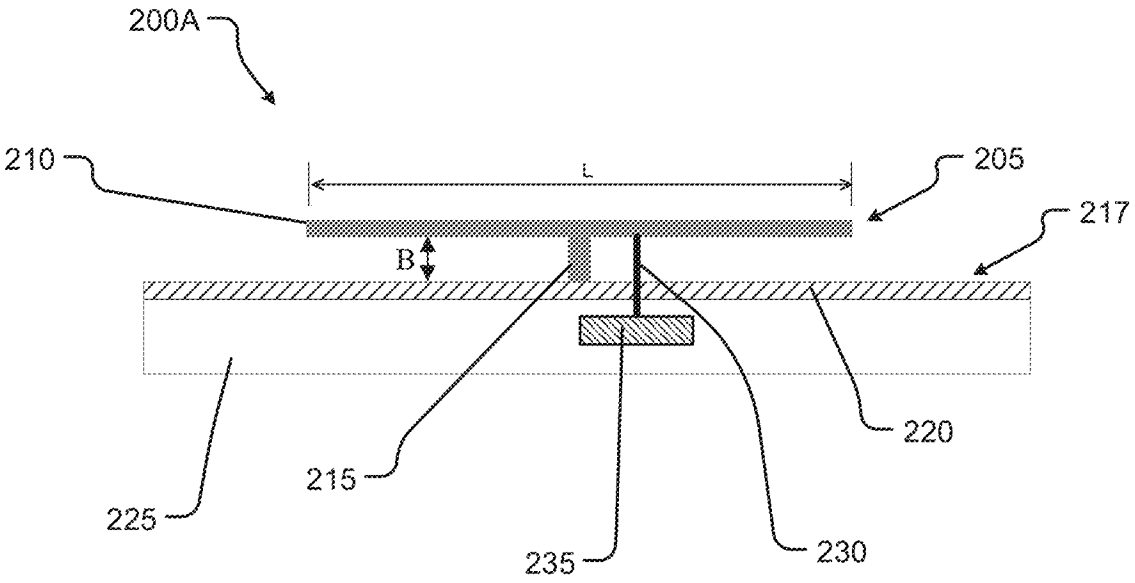
FIG. 2 illustrates a cross sectional view of an antenna structure according to at least one example embodiment.

FIG. 2 illustrates a cross sectional view of an antenna structure 200A for the antenna 115 of FIG. 1 according to at least one example embodiment.

As shown in FIG. 2, the antenna structure 200A may include a first conductive element (or antenna) 205. The first conductive element 205 includes a first planar portion 210 having a length L, and an extension portion 215 that extends away from the first planar portion 210 at a center of the first planar portion 210. The center of the first planar portion 210 may be an exact or near exact center of the first planar portion 210 in both the x and y directions (i.e., horizontal directions). Alternatively, the extension portion 215 may extend away from the first planar portion 210 at a location offset from the center if desired (e.g., according to design preferences). The antenna structure 200A may include a second conductive element 217 spaced apart from the first planar portion 210 by a desired distance.

The extension portion 215 may have a length B. In FIG. 2, the desired distance between the second conductive element 217 and the first planar portion 210 and the length of the extension portion are both equal to B. However, example embodiments are not limited thereto, as further described below with reference to FIGS. 6-7, for example.

In FIG. 2, the space between the first planar portion 210 and the second conductive element 217 is occupied by ambient air. The second conductive element 217 may include a second planar portion 220 electrically connected to the extension portion 215. In at least one example embodiment, the second planar portion 220 is a ground plate that is connected to electrical ground or a common voltage and that extends at least the length and the width of the first planar portion 210. However, example embodiments are not limited thereto and other configurations and/or dimensions of the second planar portion 220 may be selected if desired.

Figure 6:
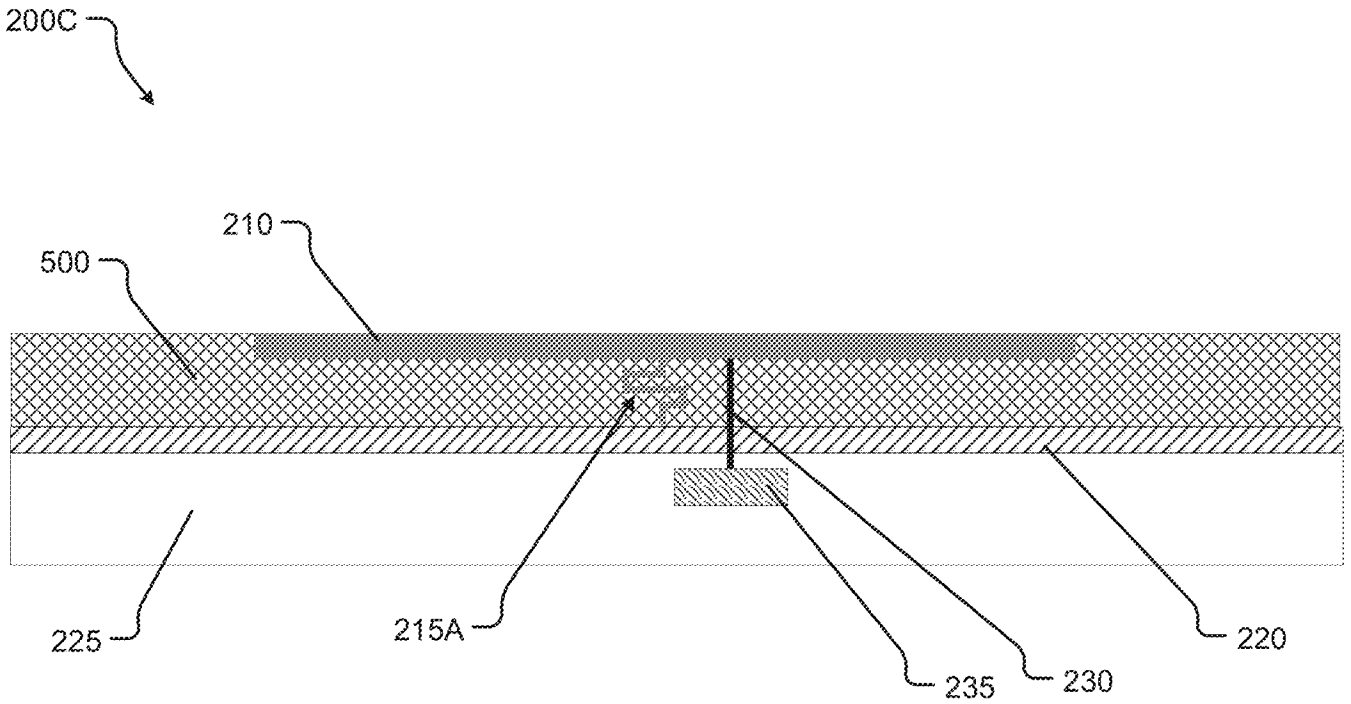
FIG. 6 illustrates a cross sectional view of an antenna structure according to at least one example embodiment.
Figure 7:
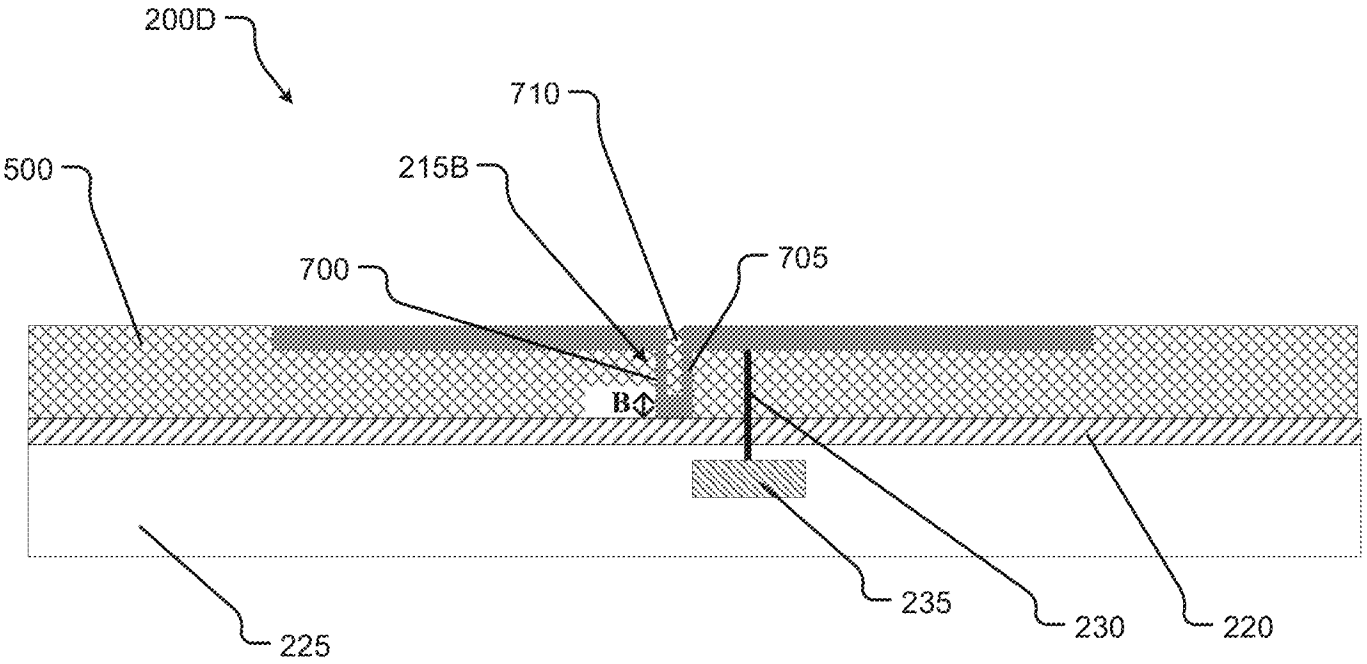
FIG. 7 illustrates a cross sectional view of an antenna structure according to at least one example embodiment.

As shown in FIG. 2, the first planar portion 210 and the second planar portion 220 extend in a first direction so as to be substantially parallel to one another. The extension portion 215 extends in a direction that is substantially perpendicular to the first direction. According to at least one example embodiment and as shown in FIG. 2, the extension portion 215 is linear. However, example embodiments are not limited thereto and other shapes of the extension portion 215 may be possible as shown in FIGS. 6, 7, and 9.

The length L and the distance B may be design parameters based on empirical evidence and/or preference (e.g., based on desired frequency band(s) for the antenna). These parameters are discussed in more detail below with reference to FIGS. 3 and 4. The first conductive element 205 and the second conductive element 217 may comprise copper or other suitable conductive material used for antenna applications.

FIG. 2 illustrates an insulating material 225 that supports the second planar section 225. The insulating material 225 may be a substrate, for example, a printed circuit board (PCB) or other insulative substrate that includes other elements of the communication device 105 mounted thereto (e.g., the IC 120).

As shown in FIG. 2, the antenna structure 200A may further include an injection port 230 coupled to a transmit/receive line 235. The injection port 230 may include a conductive strip of metal coupled to the first planar portion 210 and to the transmit receive line 235. The conductive strip of the injection port 230 that passes through at least the second planar portion 220 may be electrically insulated from the second planar portion 220, for example, by an insulating wrapper. The transmit/receive line 235 may be a conductive wiring that leads to the IC 120 so that the IC 120 can send and receive signals from the antenna structure 200A. In operation, the injection port 230 functions as an input/output port for the antenna structure 200A. FIG. 2 shows that the injection port 230 is located close to the extension portion 215, however, example embodiments are not limited thereto and the injection port 230 may be placed at some other location according to design preferences.

Figure 3:
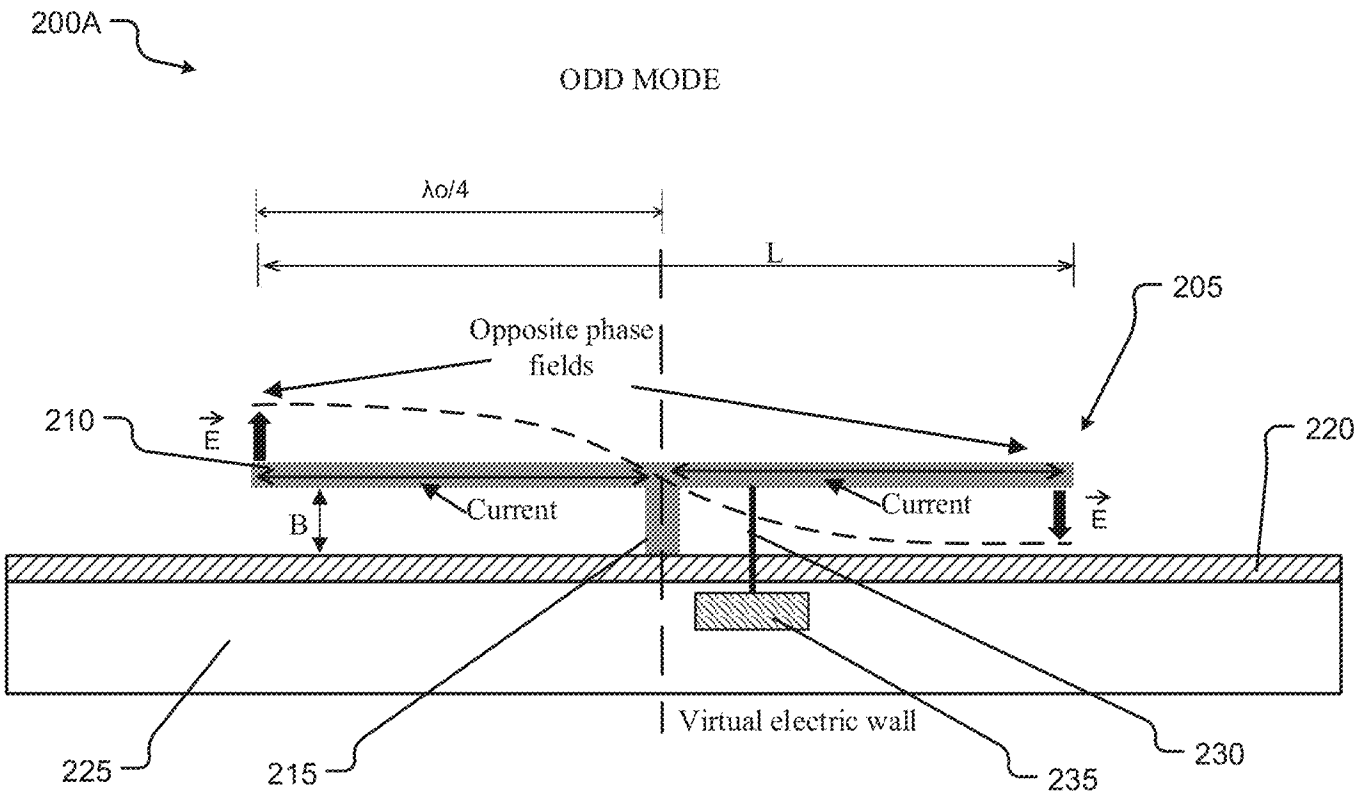
FIG. 3 illustrates a first mode of the antenna structure in FIG. 2 according to at least one example embodiment.

FIG. 3 illustrates a first mode of the antenna structure 200A in FIG. 2 according to at least one example embodiment. In more detail, FIG. 3 illustrates an odd resonant mode for the antenna structure 200A. The odd resonant mode may correspond to a mode in which the antenna structure 200A is operable in a first frequency bandwidth. As shown in FIG. 3, the odd resonant mode is symmetric (e.g., perfectly symmetric) and has a virtual electric wall or virtual ground plane) through the extension portion 215 such that no current flows to the ground plate 220 to create opposite phase electric fields E for each branch of the first planar portion 210. For each branch of the first planar portion 210, current travels a distance of L/2 (which is considered a quarter wavelength). Thus, the wavelength $\lambda o$ in the odd resonant mode $\lambda o=2L$. The resonant frequency Fo for the odd mode is $Fo=c/\lambda o$, where c is the speed of light (e.g., in m/s). In at least one example embodiment, for example, in a dual band mode Fo=2.4 GHz.

Figure 4:
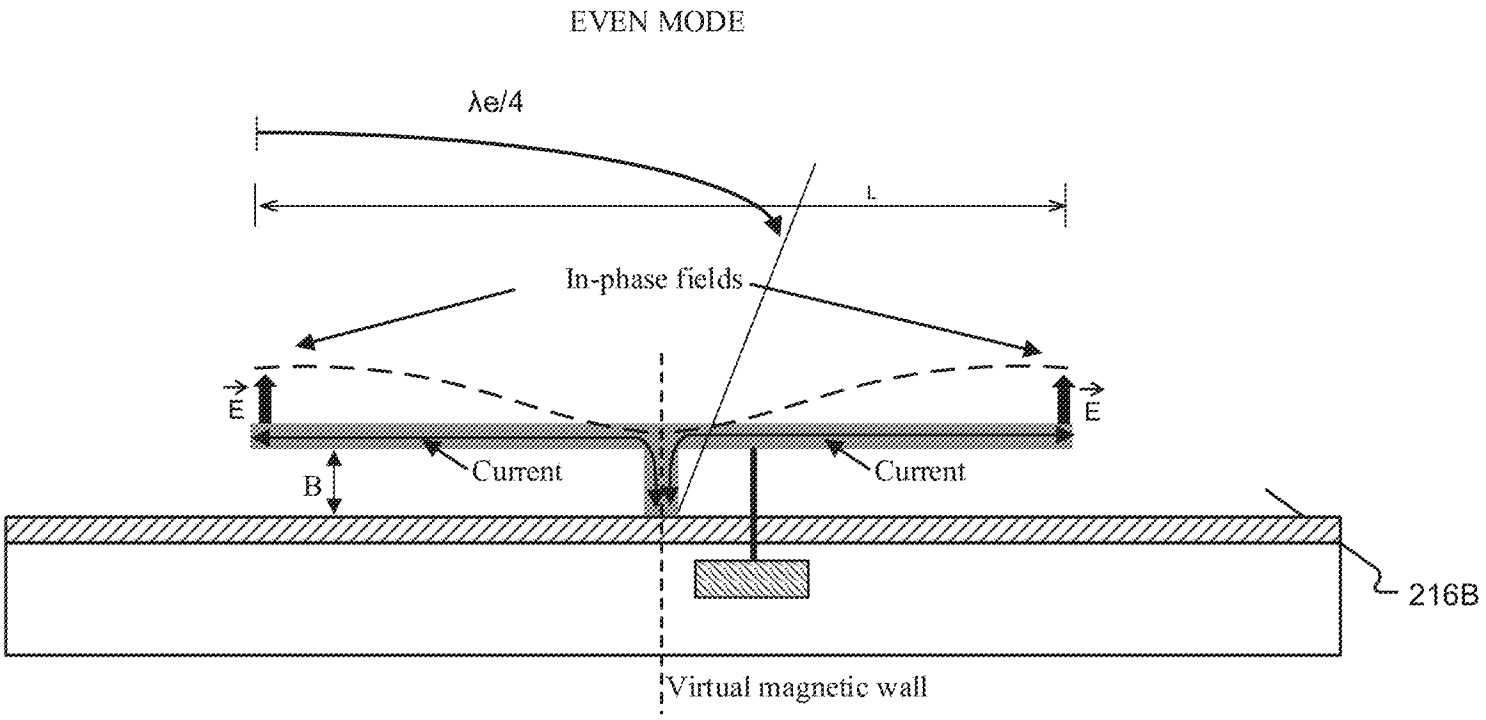
FIG. 4 illustrates a second mode of the antenna structure in FIG. 2 according to at least one example embodiment.

FIG. 4 illustrates a second mode of the antenna structure 200A in FIG. 2 according to at least one example embodiment. In more detail, FIG. 4 illustrates an even resonant mode for the antenna structure 200A. The even resonant mode may correspond to a mode in which the antenna structure 200A is operable in a second frequency bandwidth that is distinct from the first frequency bandwidth of the odd resonant mode in FIG. 3. As shown in FIG. 4, the even resonant mode is symmetric (e.g., perfectly symmetric) and has a virtual magnetic wall along the extension portion 215 such that current in each branch of the first planar portion 215 flows to the ground plate 220 through the extension portion 215 to create in-phase electric fields E for each branch. For each branch of the first planar portion 215, the current travels a distance of about a quarter wavelength $\lambda e/4$ or about L/2 (e.g., slightly greater than $\lambda e/4$ or L/2 because of the extension portion 215). Thus, the wavelength $\lambda e$ in the even resonant mode may be expressed as follows: $\lambda e \sim 2L+4B$. The resonant frequency Fe for the even mode is $Fe=c/\lambda e$. In at least one example embodiment, for example, in a dual band mode Fe=1.7 GHz.

In view of FIGS. 3 and 4, it should be appreciated that $\lambda e>\lambda o$ and that $Fe<Fo$, which may create two distinct frequency bands, one band for the odd resonant mode and one band for the even resonant mode. It should further be appreciated that the creation of two distinct frequency bands may be dependent on the distance B. For example, if the distance B is relatively large, then each resonant mode may have its own frequency band as described above. However, if the distance B is relatively small, then the frequency bands of each resonant mode may partially overlap to create a single frequency band that is wider than either of the two distinct frequency bands. In other words, the frequency bands of the odd resonant mode and the even resonant mode may be merged into a single enhanced frequency band. FIGS. 6, 7, and 9-11 illustrate examples of adjusting the distance B according to a desired frequency band of the antenna structure.

Figure 5:
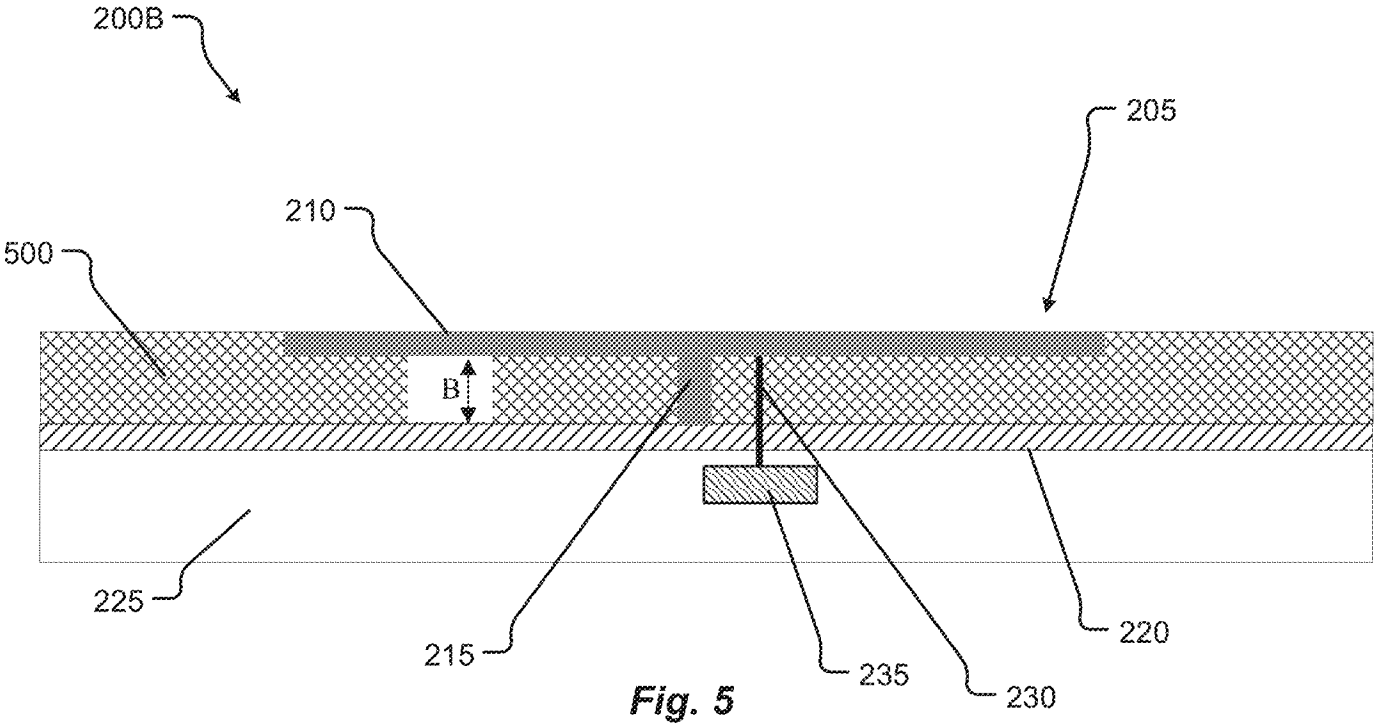
FIG. 5 illustrates a cross sectional view of an antenna structure according to at least one example embodiment.

FIG. 5 illustrates a cross sectional view of an antenna structure 200B according to at least one example embodiment. FIG. 5 is the same as FIG. 2 except for the inclusion of an insulating material 500 between the first planar portion 210 and the second planar portion 220. As shown, the extension portion 215 passes through the insulating material 500 to electrically connect with the second planar portion 220. The insulating material 500 may comprise the same or different material as the insulating material 225. For example, the insulating material 500 may be a portion of a PCB or other suitable insulative material used in antenna applications. As also shown, the injection port 230 is disposed in the insulating material 225 and includes a conductive section that passes through the second planar portion 220 and the insulating material 500 to electrically connect with the first planar portion 210. The conductive section of the injection port 230 that passes through at least the second planar portion 220 may be electrically insulated from the second planar portion 220, for example, by an insulating wrapper. As in FIG. 2, the injection port 230 is coupled to a transmit/receive line 235 of an integrated circuit 120 for the antenna structure 200B.

In FIG. 5, a top surface of the first planar portion 210 is coplanar with a top surface of the insulating material 500. However, example embodiments are not limited thereto, and the top surfaces may be offset from one another in either vertical direction.

FIG. 6 illustrates a cross sectional view of an antenna structure 200C according to at least one example embodiment. The antenna structure 200C is the same as the antenna structure 200B in FIG. 5, except that antenna structure 200C includes an extension portion 215A that is sinuous or winding. This configuration may be useful for applications where dual frequency bands are desired because the sinuous structure of the extension portion 215A serves to increase the effective length B because the current path to the ground plate 220 is longer than in FIG. 5, for example. This creates an even resonant mode with a frequency Fe lower than Fo, and even lower than the frequency Fe from FIG. 5 if the distance between planar portions 210 and 220 is maintained. That is, as the sinuous path of the extension portion 215A lengthens, Fe decreases. Accordingly, a total length of the extension portion 215A may be a design parameter set based on a desired resonant frequency Fe. This configuration allows for a dual band antenna mode while keeping the overall package compact (because the distance between the planar portions 210 and 220 need not increase from the configuration shown in FIG. 5). Here, it should be appreciated that the sinuous structure of the extension portion 215A does not affect the resonant frequency Fo in the odd resonant mode.

FIG. 7 illustrates a cross sectional view of an antenna structure 200D according to at least one example embodiment. The antenna structure 200D is the same as the antenna structure 200B in FIG. 5, except that antenna structure 200D includes an extension portion 215B that includes a first part 700 and a second part 705 spaced apart from the first part in the first direction (e.g., a horizontal direction) so that a gap 710 exists between two sections or branches of the first planar portion 210. Here, the presence of the gap 710 may serve to decrease the effective length B of the extension portion 215B compared to extension portion 215 FIG. 5. FIG. 7 may be useful for applications that desire a single wide bandwidth (e.g., at 10 dB) that is otherwise not possible or ineffective for related art patch and/or F-antenna designs. The single frequency band of the antenna structure 200D may be include and/or be wider than either of the frequency bands accomplished by the even and odd resonant modes alone.

Figure 8:
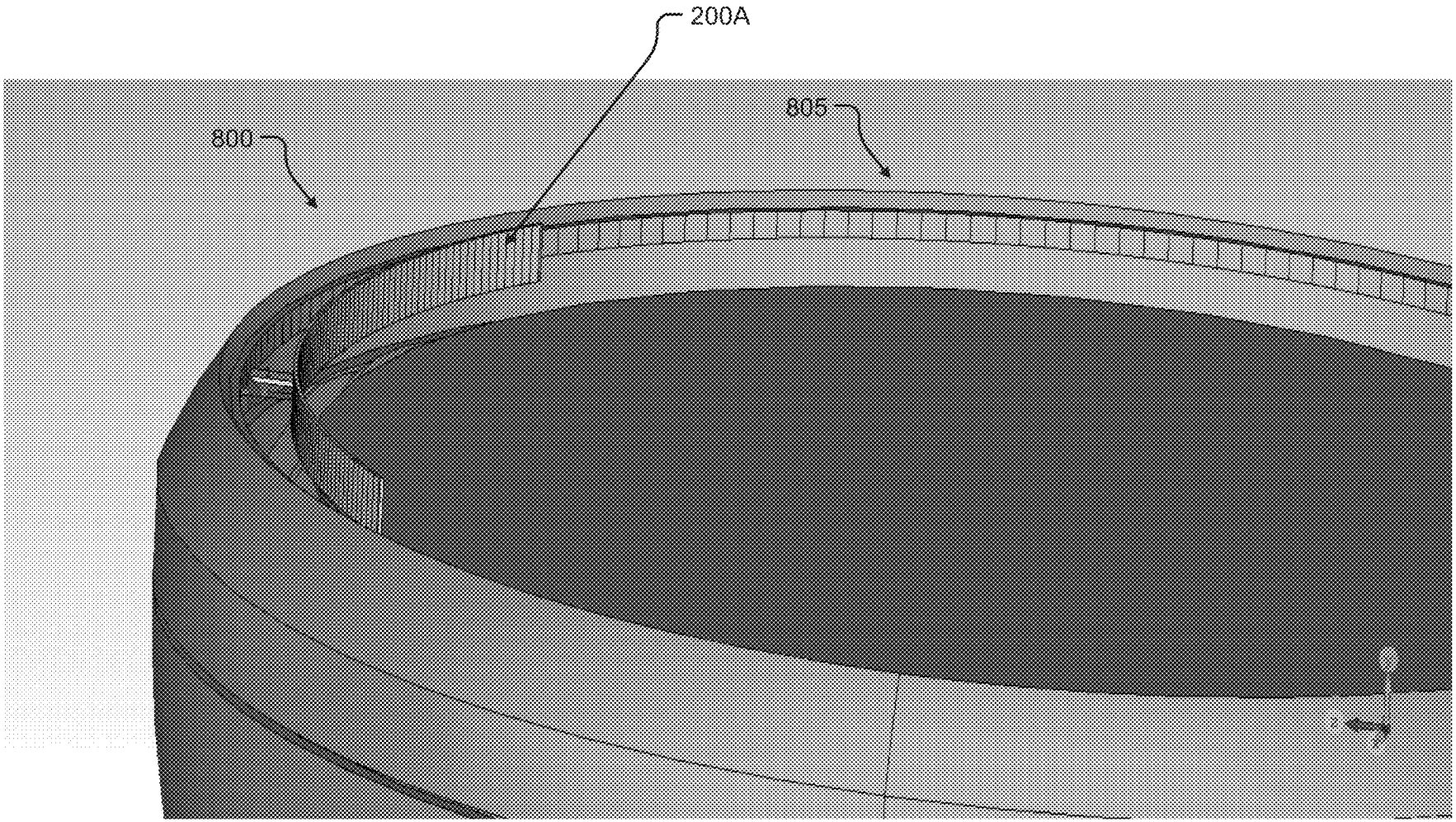
FIG. 8 illustrates a perspective view a system including an antenna structure according to at least one example embodiment.

FIG. 8 illustrates a perspective view a system 800 including an antenna structure according to at least one example embodiment. In more detail, FIG. 8 illustrates how the antenna structure 200A is mounted in a device 805. The device 805 may correspond to the communication device 105. For example, the device 805 may be a wearable device, such as a smart watch. Although FIG. 8 is described with respect to antenna structure 200A, it should be appreciated that all antenna structures described herein and within the scope of inventive concepts may be included in addition to or instead of structure 200A.

Figures 9A, 9B:
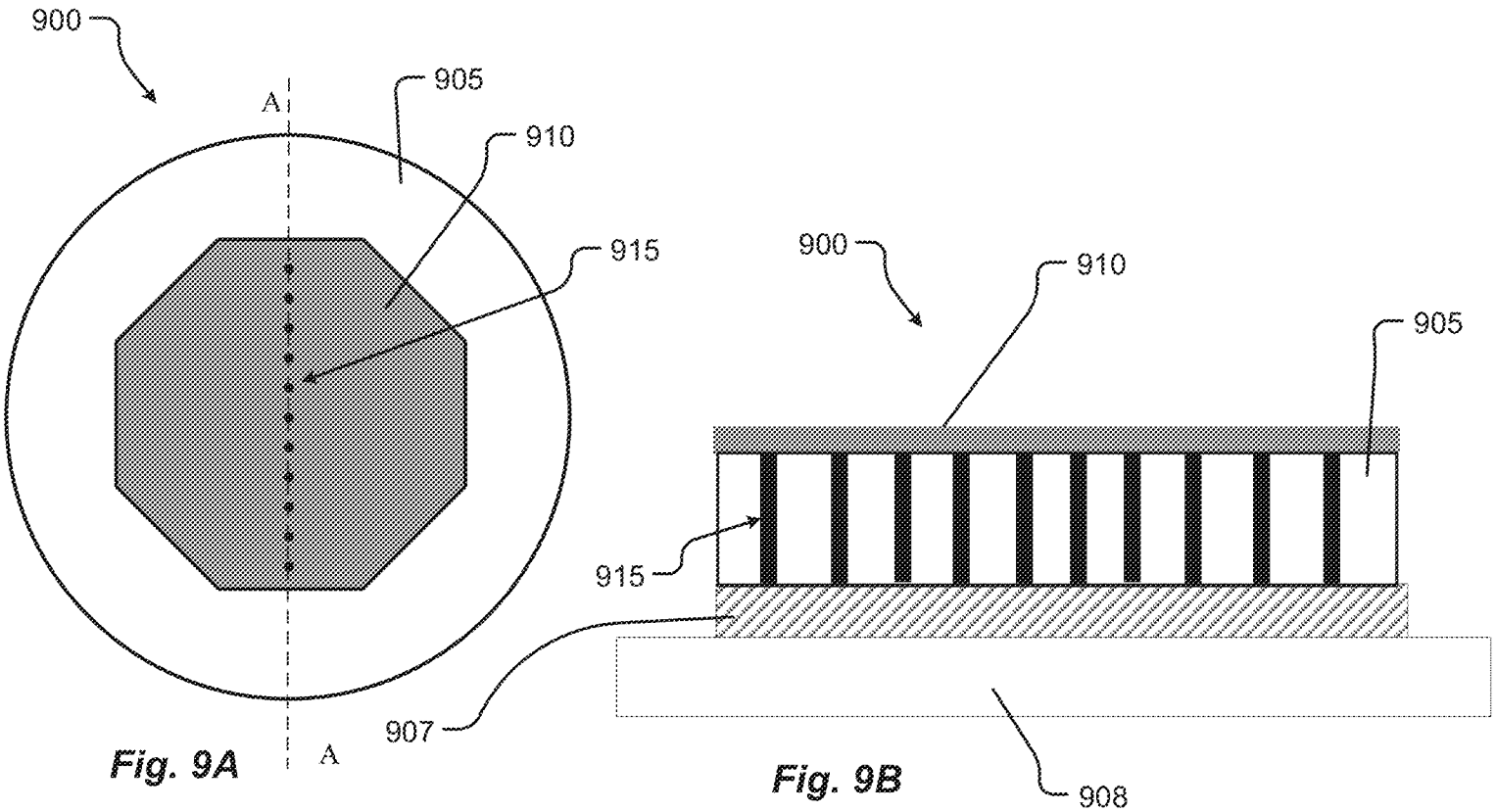
FIG. 9A illustrates a plan view of an antenna structure according to at least one example embodiment.
FIG. 9B illustrates a cross sectional view of the antenna structure in FIG. 9A.

FIG. 9A illustrates a plan view of an antenna structure 900 according to at least one example embodiment. FIG. 9B illustrates a cross sectional view of the antenna structure 900 in FIG. 9A. The antenna structure 900 may be used in the antenna 115 of FIG. 1. In more detail, FIGS. 9A and 9B are similar to FIGS. 2-7 in that the antenna structure 900 employs the same T-antenna concept, but with a wider patch-like section 910 instead of thinner T-tops as in FIG. 8. With reference to FIGS. 9A and 9B, the antenna structure 900 includes a substrate 905, a first conductive plate 907 (e.g., a ground plate) on the substrate 905, a second conductive plate 910 electrically connected to the first conductive plate 907 by a plurality of conductive vias 915. An optional carrier substrate 908 may be included if desired. Here, it should be understood that the extension portions 215, 215A, and 215B of the previous figures are represented by the plurality of conductive vias 915 positioned in a row or column at a center of the conductive plate 907. That is, the extension portion of the antenna structure 900 includes a plurality of conductive vias 905 aligned in a direction and that extend from one side of the first planar portion (e.g., 220 or 910) to an opposite side of the first planar portion (220 or 910).

The size, density, and/or position of the conductive vias 915 may affect the effective length of B. In at least one example embodiment, the conductive vias 915 function similar to the extension portion 215B in that the effective length B is relatively short, thereby creating a single wide frequency band. For example, the more tightly packed the conductive vias 915 in a row, the shorter the effective length of B which brings Fe closer to Fo to create a single frequency band (e.g., at 10 db).

In view of FIGS. 1-9, it should be understood that at least one example embodiment is directed to an antenna structure including a ground plate 220 and an antenna 205 having a T-shape that includes a top 210 and a leg 215. The top 210 of the T-shape is spaced apart from the ground plate 220, and the leg 215 of the T-shape extends away from the top 210 of the T-shape and is electrically connected to the ground plate 220. The leg 215 of the T-shape has a structure such that i) the antenna is operable for a first frequency bandwidth and a second frequency bandwidth distinct from the first frequency bandwidth, or ii) the antenna is operable for a single frequency bandwidth that is wider compared to the first and second frequency bandwidths taken alone.

In at least one example embodiment, the structure of the leg 215 of the T-shape may be a linear structure (e.g., in FIG. 5) having a length B that matches a distance between the ground plate 220 and the top 210 of the T-shape so that the antenna is operable for the first frequency bandwidth and the second frequency bandwidth.

In at least one example embodiment, the structure of the leg 215 of the T-shape is a sinuous structure (e.g., in FIG. 6) having a length B that is greater than a distance between the ground plate 220 and the top 210 of the T-shape so that the antenna is operable for the first frequency bandwidth and the second frequency bandwidth.

In at least one example embodiment, the structure of the leg 215 of the T-shape is a U-shaped structure (e.g., FIG. 7) that creates a gap 710 between two sections or branches of the top 210 of the T-shape so that the antenna is operable for the single frequency bandwidth.

In at least one example embodiment, the structure of the leg 215 of the T-shape includes a plurality of conductive vias 915 aligned with one another so that the antenna is operable for the single frequency bandwidth.

According to at least one example embodiment, the antenna structure includes a first insulating material 500 between the top 210 of the T-shape and the ground plate 220. Here, the leg 215 of the T-shape passes through the first insulating material 500 to electrically connect with the ground plate 220. At least one example embodiment includes a second insulating material 225 that supports the ground plate 220.

The antenna structure may include an injection port 230 disposed in the second insulating material 225 and that includes a conductive section that passes through the ground plate 220 and the first insulating material 500 to electrically connect with the top 210 of the T-shape. The injection port 230 is coupled to a transmit/receive line 235 of an integrated circuit 120 for the antenna structure.

Figure 10:
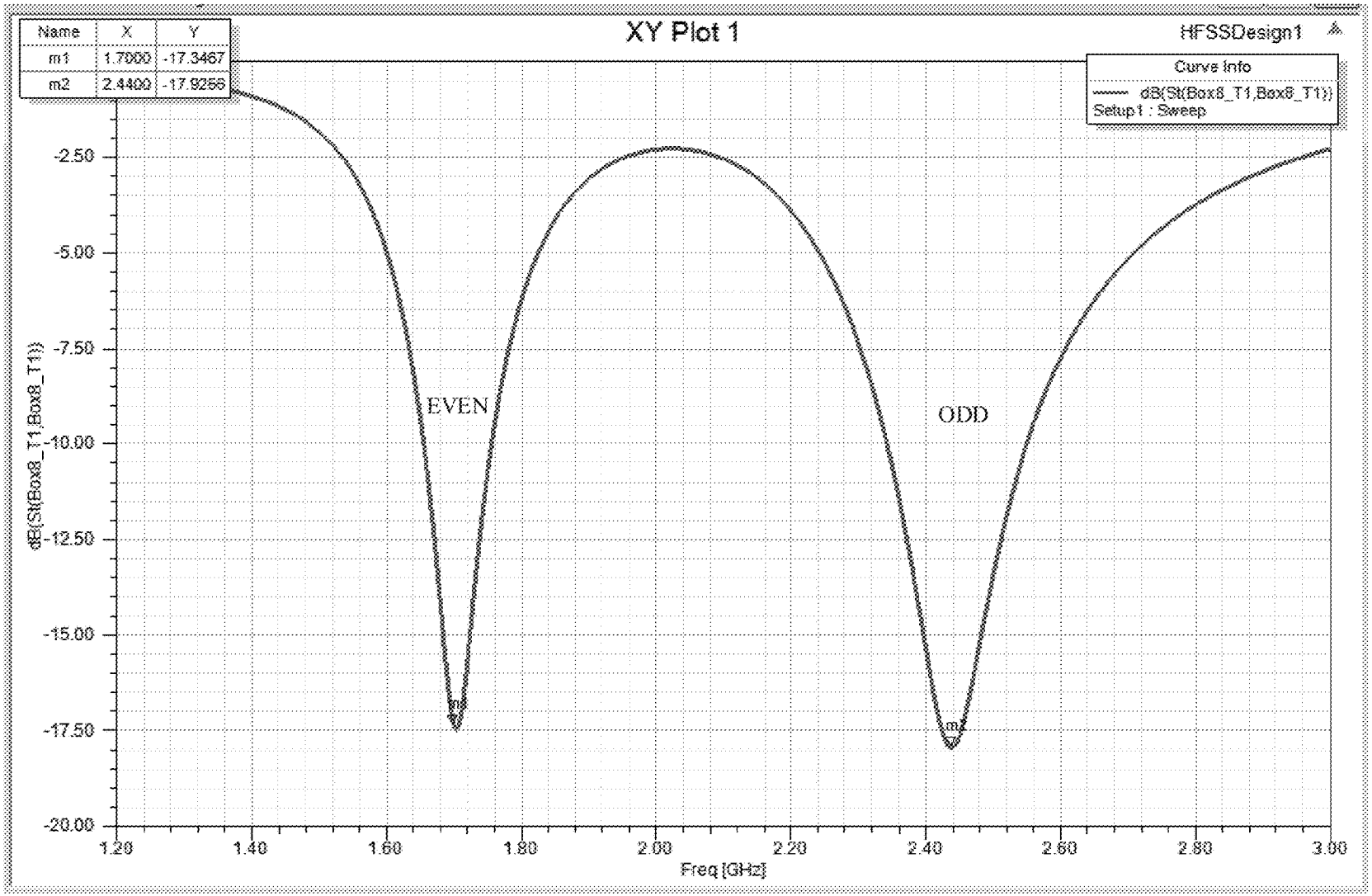
FIG. 10 illustrates an example frequency bands for operating an antenna structure in a dual band mode according to at least one example embodiment.

FIG. 10 illustrates an example frequency bands for operating an antenna structure in a dual band mode in accordance with at least one example embodiment. As shown in FIG. 10, the antenna structure operating in an even resonant mode and an odd resonant mode creates two distinct frequency bands so as to allow a single antenna to operate in multiple bands.

Figure 11:
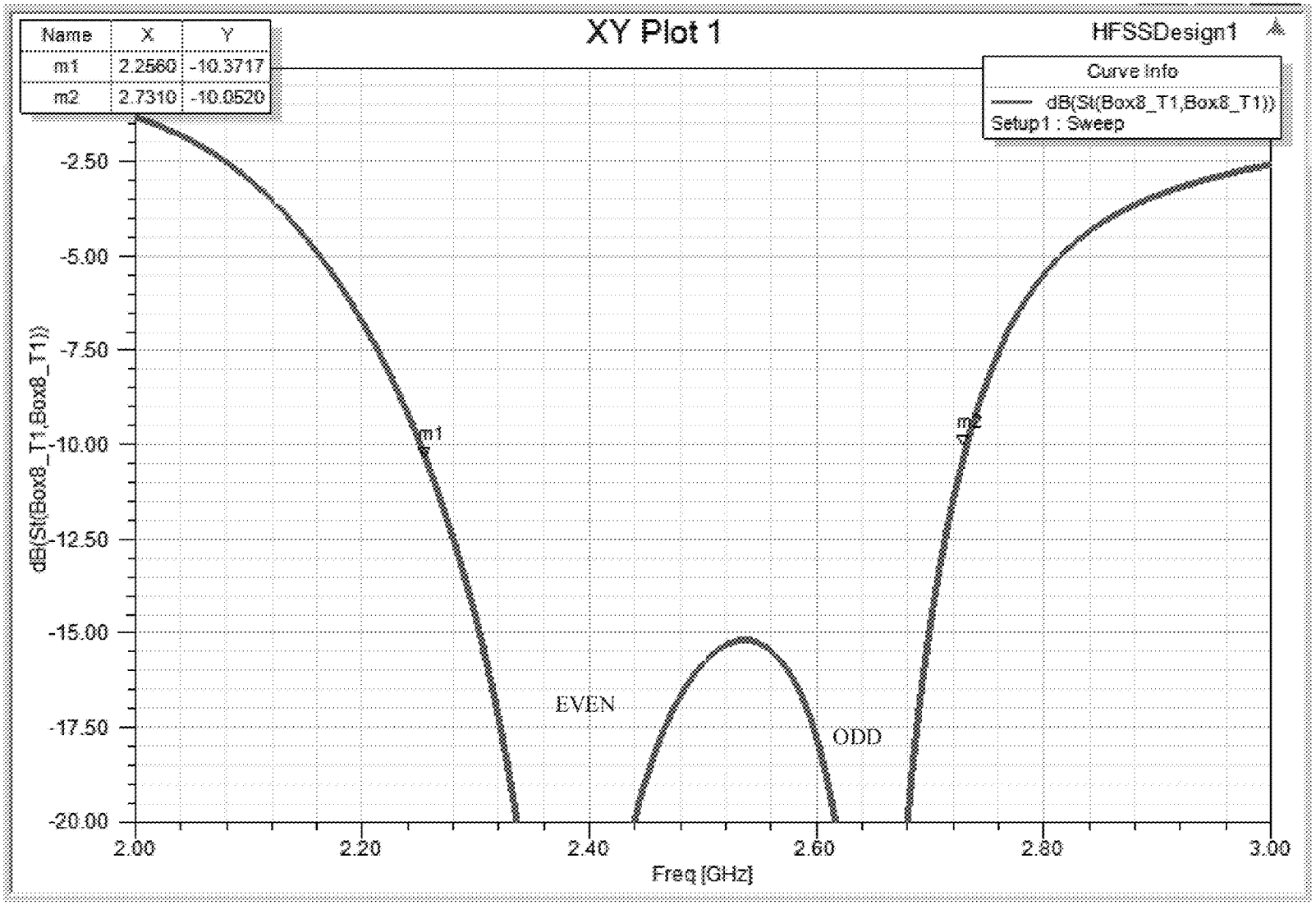
FIG. 11 illustrates an example frequency band for operating an antenna structure in a single band mode according to at least one example embodiment.

FIG. 11 illustrates an example frequency band for operating an antenna structure in a single band mode in accordance with at least one example embodiment. As may be appreciated from a comparison of FIGS. 10 and 11, operating the antenna structure according to example embodiments in a single band mode achieves a single wide frequency band that includes at least part of the frequency bands of the odd and even resonant modes and that is wider than either of the frequency bands for the odd resonant mode or the even resonant mode taken alone, for example, at 10 dB.

In view of FIGS. 1-11, it should be understood that example embodiments may include a method that includes operating a T-shaped antenna in a first mode and a second mode. The first mode is a mode in which the T-shaped antenna has a first resonant frequency (e.g., Fe) and a first frequency bandwidth, as well as a second resonant frequency (e.g., Fo) distinct from the first resonant frequency and a second frequency bandwidth distinct from the first frequency bandwidth. The second mode is a mode in which the antenna has an expanded frequency bandwidth (e.g., see FIG. 11) that may include the first and second frequency bandwidths of first mode. For example, the expanded frequency bandwidth covers a larger range of frequencies than the first mode and the second mode alone. Selection of the first mode or the second mode may be a design choice. In at least one example embodiment, a single antenna may be capable of operating in the first mode, for example, when B is a relatively large value. That is, a single antenna can transmit and receive effectively within two different frequency bands to allow communication within, for example, both GPS and WiFi frequency bands (at about 1.5 GHz and 2.44 GHz, respectively). If B is a relatively small value, then the antenna may operate in the second mode to achieve an enhanced frequency bandwidth compared to the first mode.

Although not explicitly shown, it should be understood that the value of B may be adjustable by lengthening or shortening the extension portion 215. For example, the extension portion 215 may exist in segments with at least one of the segments being attached to one or more mechanisms that move (e.g., horizontally move) a respective segment in or out of alignment with other segments of the extension portion 215 electrically connected to the planar portion 210. Here, the substrate 225 may also be attached to one or more mechanisms so as to be movable in a vertical direction (e.g., further away from or closer to the extension portion 215) to allow for the exchange of extension portion segments and then re-connection. In view of the above, it should be appreciated that example embodiments provide a single antenna or resonator with multiple possible operating modes while maintaining high levels of radiation efficiency, desirable radiation pattern, high gain, improved bandwidth, etc.

Although example embodiments have been described with reference to specific elements in the figures, it should be understood that elements of some embodiments may be added or removed to/from other embodiments if desired.

According to at least one example embodiment, an antenna structure includes a first conductive element including a first planar portion, and an extension portion that extends away from the first planar portion at a center of the first planar portion. The antenna structure may include a second conductive element spaced apart from the first planar portion and electrically connected to the extension portion.

According to at least one example embodiment, the second conductive element includes a second planar portion, the first planar portion and the second planar portion extend in a first direction so as to be substantially parallel to one another, and the extension portion extends in a direction that is substantially perpendicular to the first direction.

According to at least one example embodiment, the extension portion is linear.

According to at least one example embodiment, the extension portion is sinuous.

According to at least one example embodiment, the extension portion includes a first part and a second part spaced apart from the first part in the first direction so that a gap exists between two sections of the first planar portion.

According to at least one example embodiment, the extension portion includes separable segments.

According to at least one example embodiment, the extension portion includes a plurality of conductive vias aligned in the first direction and that extend from one side of the first planar portion to an opposite side of the first planar portion.

According to at least one example embodiment, the antenna structure includes a first insulating material between the first planar portion and the second conductive element. The extension portion passes through the first insulating material to electrically connect with the second conductive element.

According to at least one example embodiment, the antenna structure includes a second insulating material that supports the second conductive element.

According to at least one example embodiment, the antenna structure includes an injection port disposed in the second insulating material and includes a conductive section that passes through the second conductive element and the first insulating material to electrically connect with the first planar portion. The injection port is coupled to a transmit/receive line of an integrated circuit for the antenna structure.

According to at least one example embodiment, the second conductive element is grounded.

According to at least one example embodiment, an antenna structure includes a ground plate, and an antenna having a T-shape that includes a top and a leg. The top of the T-shape is spaced apart from the ground plate, and the leg of the T-shape extends away from the top of the T-shape and is electrically connected to the ground plate. The leg of the T-shape has a structure such that i) the antenna is operable for a first frequency bandwidth and a second frequency bandwidth distinct from the first frequency bandwidth, or ii) the antenna is operable for a single frequency bandwidth that is wider compared to the first and second frequency bandwidths taken alone.

According to at least one example embodiment, the structure of the leg of the T-shape is a linear structure having a length that matches a distance between the ground plate and the top of the T-shape so that the antenna is operable for the first frequency bandwidth and the second frequency bandwidth.

According to at least one example embodiment, the structure of the leg of the T-shape is a sinuous structure having a length that is greater than a distance between the ground plate and the top of the T-shape so that the antenna is operable for the first frequency bandwidth and the second frequency bandwidth.

According to at least one example embodiment, wherein the structure of the leg of the T-shape is a U-shaped structure that creates a gap between two sections of the top of the T-shape so that the antenna is operable for the single frequency bandwidth.

According to at least one example embodiment, the structure of the leg of the T-shape includes a plurality of conductive vias aligned with one another so that the antenna is operable for the single frequency bandwidth.

According to at least one example embodiment, the antenna structure includes a first insulating material between the top of the T-shape and the ground plate, and the leg of the T-shape passes through the first insulating material to electrically connect with the ground plate.

According to at least one example embodiment, the antenna structure includes a second insulating material that supports the ground plate.

According to at least one example embodiment, the antenna structure includes an injection port disposed in the second insulating material and includes a conductive section that passes through the ground plate and the first insulating material to electrically connect with the top of the T-shape. the injection port being coupled to a transmit/receive line of an integrated circuit for the antenna structure.

According to at least one example embodiment, an antenna includes a ground plate and a T-shaped antenna structure in electrical contact with the ground plate and configured to operate in a first mode or a second mode. The first mode is a mode in which the T-shaped antenna structure is operable in a first frequency bandwidth and a second frequency bandwidth distinct from the first frequency bandwidth, and the second mode is a mode in which the T-shaped antenna structure is operable in an expanded frequency bandwidth that includes the first frequency bandwidth and the second frequency bandwidth.

The phrases "at least one", "one or more", "or", and "and/or" are open-ended expressions that are both conjunctive and disjunctive in operation. For example, each of the expressions "at least one of A, B and C", "at least one of A, B, or C", "one or more of A, B, and C", "one or more of A, B, or C", "A, B, and/or C", and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

The term "computer-readable medium" or "memory" as used herein refers to any computer-readable storage and/or transmission medium that participate in providing instructions to a processor for execution. Such a computer-readable medium can be tangible, non-transitory, and non-transient and take many forms, including but not limited to, non-volatile media, volatile media, and transmission media and includes without limitation random access memory ("RAM"), read only memory ("ROM"), and the like. Non-volatile media includes, for example, NVRAM, or magnetic or optical disks. Volatile media includes dynamic memory, such as main memory. Common forms of computer-readable media include, for example, a floppy disk (including without limitation a Bernoulli cartridge, ZIP drive, and JAZ drive), a flexible disk, hard disk, magnetic tape or cassettes, or any other magnetic medium, magneto-optical medium, a digital video disk (such as CD-ROM), any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored. Computer-readable storage medium commonly excludes transient storage media, particularly electrical, magnetic, electromagnetic, optical, magneto-optical signals.

A computer readable signal medium may be any computer readable medium that is not a computer readable storage medium and that can communicate, propagate, or transport a program for use by or in connection with an instruction execution system, apparatus, or device. A computer readable signal medium may convey a propagated data signal with computer readable program code embodied therein, for example, in baseband or as part of a carrier wave. Such a propagated signal may take any of a variety of forms, including, but not limited to, electro-magnetic, optical, or any suitable combination thereof. Program code embodied on a computer readable signal medium may be transmitted using any appropriate medium, including but not limited to wireless, wireline, optical fiber cable, RF, etc., or any suitable combination of the foregoing.

The terms "determine", "calculate" and "compute," and variations thereof, as used herein, are used interchangeably and include any type of methodology, process, mathematical operation or technique.

The term "means" as used herein shall be given its broadest possible interpretation in accordance with 35 U.S.C., Section(s) 112(f) and/or 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The term "module" as used herein refers to any known or later developed hardware, software, firmware, artificial intelligence, fuzzy logic, or combination of hardware and software that is capable of performing the functionality associated with that element.

Examples of the processors as described herein may include, but are not limited to, at least one of Qualcomm® Snapdragon® 800 and 801, Qualcomm® Snapdragon® 610 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARM926EJ-S™ processors, other industry-equivalent processors, and may perform computational functions using any known or future-developed standard, instruction set, libraries, and/or architecture.

Any of the steps, functions, and operations discussed herein can be performed continuously and automatically.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, sub combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An antenna structure, comprising:

a first conductive element including:

a first planar portion having a first end and a second end, wherein the first planar portion is linear shaped; and an extension portion that extends away from the first planar portion at a substantially exact center of the first planar portion between the first end and the second end; and a second conductive element spaced apart from the first planar portion and electrically connected to the extension portion, wherein an effective length of the extension portion places the antenna structure into either a first mode or a second mode, wherein the first mode is a mode with two distinct bandwidths, and wherein the second mode is a mode with a single bandwidth that covers a larger range of frequencies than the two distinct bandwidths combined at a given gain.

2. The antenna structure of claim 1, wherein the second conductive element includes a second planar portion, wherein the first planar portion and the second planar portion extend in a first direction so as to be substantially parallel to one another, and wherein the extension portion extends in a direction that is substantially perpendicular to the first direction.

3. The antenna structure of claim 2, wherein the extension portion is linear.

4. The antenna structure of claim 2, wherein the extension portion is sinuous.

5. The antenna structure of claim 2, wherein the extension portion includes a first part and a second part spaced apart from the first part in the first direction, and wherein a gap an insulating material exists between the first part and the second part in the first direction.

6. The antenna structure of claim 2, wherein the extension portion includes separable segments, and wherein, to lengthen and shorten the extension portion, a first segment of the separable segments is attached to a mechanism that moves the first segment in the first direction in and out of alignment with a second segment of the separable segments, and wherein the second conductive element is attached to a mechanism that moves in a second direction to electrically connect the second conductive element to the separable segments and to electrically disconnect the second conductive element from the separable segments.

7. The antenna structure of claim 1, further comprising:

a first insulating material between the first planar portion and the second conductive element, wherein the extension portion passes through the first insulating material to electrically connect with the second conductive element.

8. The antenna structure of claim 7, further comprising:

a second insulating material that supports the second conductive element.

9. The antenna structure of claim 8, further comprising:

an injection port disposed in the second insulating material and that includes a conductive section that passes through the second conductive element and the first insulating material to electrically connect with the first planar portion, the injection port being coupled to a transmit/receive line of an integrated circuit for the antenna structure.

10. The antenna structure of claim 1, wherein the second conductive element is grounded.

11. An antenna structure, comprising:

a ground plate; and an antenna having a T-shape that includes a top and a leg, the top of the T-shape being spaced apart from the ground plate, the leg of the T-shape extending away from the top of the T-shape at a substantially exact center of the top and electrically connected to the ground plate, the leg of the T-shape having a structure such that i) in a first mode when the leg of the T-shape is a first length, the antenna is operable in a first frequency bandwidth and a second frequency bandwidth distinct from the first frequency bandwidth, and ii) in a second mode when the leg of the T-shape is a second length less than the first length, the antenna is operable in a single frequency bandwidth that is wider compared to the first and second frequency bandwidths taken alone.

12. The antenna structure of claim 11, wherein the structure of the leg of the T-shape is a linear structure, and wherein the first length matches a distance between the ground plate and the top of the T-shape so that the antenna is operable for the first frequency bandwidth and the second frequency bandwidth.

13. The antenna structure of claim 11, wherein the structure of the leg of the T-shape is a sinuous structure, and wherein the first length is greater than a distance between the ground plate and the top of the T-shape so that the antenna is operable for the first frequency bandwidth and the second frequency bandwidth.

14. The antenna structure of claim 11, wherein the structure of the leg of the T-shape is a U-shaped structure that creates a gap between two sections of the top of the T-shape so that the leg has the second length and the antenna is operable for the single frequency bandwidth.

15. The antenna structure of claim 11, wherein the structure of the leg of the T-shape includes a plurality of conductive vias aligned with one another so that the leg has the second length and the antenna is operable for the single frequency bandwidth.

16. The antenna structure of claim 11, further comprising:

a first insulating material between the top of the T-shape and the ground plate, wherein the leg of the T-shape passes through the first insulating material to electrically connect with the ground plate.

17. The antenna structure of claim 16, further comprising:

a second insulating material that supports the ground plate.

18. The antenna structure of claim 17, further comprising:

an injection port disposed in the second insulating material and that includes a conductive section that passes through the ground plate and the first insulating material to electrically connect with the top of the T-shape, the injection port being coupled to a transmit/receive line of an integrated circuit for the antenna structure.

19. An antenna, comprising:

a ground plate; and a T-shaped antenna structure with a leg of the T-shaped antenna structure extending away from a top of the T-shaped antenna structure at a substantially exact center of the top of the T-shaped antenna structure, the leg being in electrical contact with the ground plate and configured to operate in a first mode or a second mode, the first mode being a mode in which the T-shaped antenna structure is operable in a first frequency bandwidth and a second frequency bandwidth distinct from the first frequency bandwidth, the second mode being a mode in which the T-shaped antenna structure is operable in an expanded frequency bandwidth that is wider than the first frequency bandwidth and the second frequency bandwidth combined at a given gain.

* * * * *